US011970854B2

(12) United States Patent
Rideout et al.

(10) Patent No.: US 11,970,854 B2
(45) Date of Patent: Apr. 30, 2024

(54) PARTITION COMPRISING BOARDS MOUNTED ONTO UPRIGHT ELONGATE MEMBERS AND METHOD FOR CONSTRUCTING THE SAME

(71) Applicant: SAINT-GOBAIN PLACO, Courbevoie (FR)

(72) Inventors: Jan Rideout, Coventry (GB); Nicholas Jones, Coventry (GB)

(73) Assignee: Saint-Gobain Placo, Courbevoie (FR)

( * ) Notice: Subject to any disclaimer, the term of this patent is extended or adjusted under 35 U.S.C. 154(b) by 0 days.

(21) Appl. No.: 17/271,082

(22) PCT Filed: Sep. 10, 2019

(86) PCT No.: PCT/GB2019/052523
§ 371 (c)(1),
(2) Date: Feb. 24, 2021

(87) PCT Pub. No.: WO2020/065259
PCT Pub. Date: Apr. 2, 2020

(65) Prior Publication Data

US 2021/0214937 A1 Jul. 15, 2021

(30) Foreign Application Priority Data

Sep. 24, 2018 (GB) ..... 1815518

(51) Int. Cl.
*E04B 2/74* (2006.01)
*E04B 2/72* (2006.01)
*E04B 2/78* (2006.01)

(52) U.S. Cl.
CPC ..... *E04B 2/7457* (2013.01); *E04B 2/723* (2013.01); *E04B 2002/7477* (2013.01); *E04B 2/789* (2013.01)

(58) Field of Classification Search
CPC ..... E04B 2001/2481; E04B 2/28; E04B 2/30; E04B 2/34; E04B 2/38; E04B 2/40;
(Continued)

(56) References Cited

U.S. PATENT DOCUMENTS 1,654,030 A * 12/1927 Ashenhurst ..... E04B 1/82 52/375
4,479,335 A 10/1984 Roberts
(Continued)

FOREIGN PATENT DOCUMENTS

CN 205 712 601 U 11/2016
DE 19528825 A1 * 2/1997 ..... E04B 2/7409
(Continued)

OTHER PUBLICATIONS

International Search Report and Written Opinion dated Dec. 4, 2019 for International Application No. PCT/GB2019/052523, 12 pages.

*Primary Examiner* — Theodore V Adamos
(74) *Attorney, Agent, or Firm* — McDonnell Boehnen Hulbert & Berghoff LLP

(57) ABSTRACT

A partition, mounted on a mounting surface, comprises a plurality of elongate upright members, a first board and a second board. The first board is mounted on one side of a pair of the elongate upright members that are adjacent to each other, and the second board is mounted on the other side of the same pair of adjacent elongate upright members, so as to provide a cavity between the pair of elongate upright members and the first and second boards. The partition further comprises a spacer that is located within the cavity, the maximum dimension of the spacer in the through-thickness direction of the partition being at least 90% of the separation of the two boards. The spacer may help to reduce the extent of inward bowing of the boards between adjacent
(Continued)

elongate upright members, so that, for example, the upright members may be spaced further apart.

20 Claims, 2 Drawing Sheets

(58) Field of Classification Search
CPC ..... E04B 2/7409; E04B 2002/7477; E04B 2/789; E04B 2/7407; E04B 2/723; E04B 2/7457
See application file for complete search history.

(56) References Cited

U.S. PATENT DOCUMENTS 4,952,450 A * 8/1990 Noel ..... E02D 31/02 428/184
5,519,971 A * 5/1996 Ramirez ..... E04C 2/288 52/586.1
5,601,888 A * 2/1997 Fowler ..... C04B 28/14 428/68
5,854,443 A * 12/1998 Reiker ..... H02G 3/20 174/58
8,359,799 B2 * 1/2013 Shapiro ..... E04F 13/0837 52/351
2005/0183367 A1 * 8/2005 Lembo ..... E04B 1/7662 52/404.1
2006/0117689 A1 * 6/2006 Onken ..... E04C 2/22 52/309.7
2006/0201089 A1 * 9/2006 Duncan ..... E04B 1/767 52/309.8
2009/0159173 A1 * 6/2009 Skinner ..... C04B 28/144 156/42
2010/0058700 A1 * 3/2010 LeBlang ..... E04B 1/80 249/19
2013/0192157 A1 8/2013 Coyle
2014/0259970 A1 * 9/2014 Shapiro ..... E04B 2/02 52/27
2016/0096772 A1 4/2016 Hotchin et al.

FOREIGN PATENT DOCUMENTS

DE 10232855 A1 * 2/2004 ..... E04B 1/7666
JP H06306974 A 11/1994
JP H10 46712 2/1998
NL 1 008 951 10/1999
WO WO-2014080022 A1 * 5/2014 ..... E04B 1/40

* cited by examiner

PARTITION COMPRISING BOARDS MOUNTED ONTO UPRIGHT ELONGATE MEMBERS AND METHOD FOR CONSTRUCTING THE SAME

CROSS-REFERENCE TO RELATED APPLICATIONS

This application is a U.S. National Stage entry of International Patent Application no. PCT/GB2019/052523, filed Sep. 10, 2019, which claims the benefit of priority of United Kingdom Patent Application no. 1815518.4, filed Sep. 24, 2018.

FIELD OF THE INVENTION

The present invention relates to a partition comprising upright elongate members onto which boards are mounted, the partition including a spacer positioned between boards that are on opposite sides of the partition. The invention further relates to a method of constructing such a partition.

BACKGROUND TO THE INVENTION

It is known to provide partitions comprising a stud framework on which boards are mounted. The stud framework typically comprises elongate timber members or elongate metal members (typically steel members). The boards may be provided by e.g. gypsum plasterboard. It is desirable to reduce the total amount and/or cost of materials used in the partition, along with the time required to install the partition. At the same time, it is important that users of the structure or building in which the partition is located perceive the partition as being sturdy and robust.

SUMMARY OF THE INVENTION

It has been found that when a partition comprises boards having a high stiffness, it is possible to reduce the amount of material in the stud framework e.g. by using thinner elongate members or fewer elongate members. This may help to reduce the material costs and/or the installation costs of the partition. For example, it is possible to space upright members further apart and/or to reduce the number of cross-members between the upright members, or to eliminate the cross-members entirely.

Preferably, a spacer is provided between the boards to help reduce the extent of inward bowing of the boards between adjacent elongate upright members. The spacer typically comprises a small polymer block that is generally cheap, light, and quick to install, and so the overall cost of the partition (both in terms of material costs and installation costs) typically remains lower than for conventional partitions.

Therefore, in a first aspect, the present invention may provide a partition mounted on a mounting surface, the partition comprising a plurality of elongate upright members;

the partition further comprising a first board and a second board, the first board being mounted on one side of a pair of the elongate upright members that are adjacent to each other and the second board being mounted on the other side of the same pair of adjacent elongate upright members, so as to define a cavity between the pair of adjacent elongate upright members and the first and second boards;

the partition further comprising a spacer, the spacer being located within the cavity defined by the pair of adjacent elongate upright members and the first and second boards, the maximum dimension of the spacer in the through-thickness direction of the partition being at least 90% of the separation of the two boards;

the partition being configured such that the spacer does not provide a load-transferring cross-member between the pair of adjacent elongate upright members;

the partition being further configured such that the spacer does not provide a load-transferring member between the mounting surface and either of the first and second boards.

Thus, the spacer does not provide a means for transferring load around a stud framework in a partition. Typically, the spacer is not in contact with either of the pair of adjacent elongate upright members. Preferably, the gap between the spacer surface and the closest surface of an elongate upright member is at least 200 mm. Preferably, the gap between the spacer surface and the perimeters of the inner faces of the first and second boards is at least 200 mm (the inner faces being the faces that are directed towards the cavity).

Preferably, the flexural stiffness of the first board in at least one in-plane direction of the board is at least 3.5 GPa, preferably at least 4.5 GPa, more preferably at least 5 GPa.

The flexural stiffness of the first board is derived by adapting the test method set out in BS EN 520: 2004+A1: 2009 in relation to the measurement of flexural bending load. That is, the board is cut to provide a specimen having the following dimensions: 400 mm×300 mm×12.5 mm. The specimen is rested on two parallel supports having a separation of 350 mm (measured between the centres of the supports) and each being rounded to a radius between 3 mm and 15 mm. The specimen is tested at a constant downward force (250N/min) in the centre of the specimen at an equal distance from both supports. The gradient of the curve of force (N) versus displacement (m) is determined during elastic deformation of the board (that is, before reaching the elastic limit).

The flexural stiffness is calculated using the following formula:

$$\text{Flexural stiffness}=L^3F/4wh^3d$$

Where:

L=separation of the supports (0.350 m)

w=width of the sample (0.300 m)

h=thickness of the sample (0.0125 m)

F/d=gradient of the curve of force (N) versus displacement (m) during elastic deformation of the board (that is, before reaching the elastic limit).

The flexural stiffness of the first board in a given direction corresponds to the flexural stiffness of that board when bent about an axis perpendicular to that direction.

In certain cases, the at least one in-plane direction of the board may correspond to the longitudinal direction of the board.

For example, the first board may comprise fibres that have a preferential direction of alignment that may correspond to the direction of deposition of the board during manufacture (this direction is sometimes referred to as the "machine direction"). Typically, this direction corresponds to the longitudinal direction of the board. In such cases, the at least one in-plane direction of the board may correspond to the preferential direction of alignment of the fibres.

Preferably, the flexural stiffness of the first board in at least one in-plane direction of the board is at least 3.5 GPa, preferably at least 4.5 GPa, more preferably at least 5 GPa and the flexural stiffness of the first board in the in-plane cross direction perpendicular to the at least one in-plane direction is greater than 3 GPa, preferably greater than 3.5 GPa, more preferably greater than 4 GPa.

Typically, the maximum flexural stiffness of the first board in the at least one in-plane direction of the board is less than 15 GPa, in general less than 10 GPa.

The elongate upright members are arranged to transfer loads between the mounting surface, such as a floor, and one or both of the first and second boards. The elongate upright members may comprise part of a stud framework. The partition may further comprise one or more connecting members that extend from one elongate upright member to an adjacent elongate upright member.

Typically, the distance between the pair of adjacent elongate upright members is at least 700 mm, preferably at least 800 mm. This separation is higher than the typical separation of 600 mm in conventional partitions. In certain embodiments, the separation of the adjacent pair of upright elongate upright members may be e.g. 900 mm or greater.

Typically, the first board and the second board are mounted on the elongate upright members such that their perimeters coincide when viewed in the through-thickness direction of the partition. This is in contrast to certain conventional partitions, in which the boards are arranged in a staggered configuration, that is, the boards are offset relative to each other along the length of the partition, such that the overlap between two boards on opposite sides of a partition is about 50% of the board face. It has been found that this conventional staggered arrangement often leads to problems after plastering of the boards, in that the plaster may crack at the joints between adjacent boards on the same side of the partition. This problem may be reduced by using a configuration in which there is effectively full overlap between pairs of boards on opposite sides of the partition.

Typically, the spacer contacts both boards. This may help to further reduce inward bowing of the boards, and may also help to prevent cracking of any plaster that has been applied to the boards. Such cracking may otherwise occur at the joints between adjacent boards on the same side of the partition. In fact, it is preferred that the spacer experiences compressive loading in the through-thickness direction of the partition, such that the spacer exhibits a compressive strain of, for example, at least 0.5% in the through-thickness direction of the partition, preferably at least 2%, more preferably at least 4%, most preferably at least 6%. That is, it is preferable that the gap between the boards, and consequently the thickness of the spacer when located within the gap, is less than the equivalent dimension of the spacer in its relaxed state.

Preferably, the spacer has a maximum dimension of 200 mm, more preferably of 150 mm, the maximum dimension of the spacer being aligned with the planes of the first and second boards. This allows the spacer to be accommodated more easily within the partition when the spacer is held under compressive loading.

In certain embodiments, the first board comprises hydraulic cement as its principal component by weight.

In other embodiments, the first board comprises gypsum as its main component by weight.

For example, the first board may be provided by a gypsum plasterboard. In such cases, the first board may comprise a gypsum matrix having fibres distributed therein and/or a polymeric additive. The fibres are typically present in an amount of at least 1 wt % relative to the weight of the gypsum, preferably at least 2 wt %. In general, the fibres are present in an amount of less than 20 wt % relative to the weight of the gypsum, preferably less than 15 wt %, more preferably less than 10 wt %. The fibres may comprise, for example, glass fibres (typically having a length in the range 10-50 mm) and/or cellulosic fibres (typically having a length in the range 0.1-0.5 mm). The polymeric additive is typically present in an amount of at least 1 wt % relative to the weight of the gypsum, preferably at least 3 wt %, more preferably at least 5 wt %. In general, the polymeric additive is present in an amount of less than 30 wt % relative to the weight of the gypsum, preferably less than 25 wt %, more preferably less than 20 wt %. The polymeric additive may comprise, for example, starch and/or a synthetic polymer, such as polyvinyl acetate. The starch may be e.g. cationic starch, ethylated starch, and/or dextrin. Further examples of compounds that may be used as the polymeric additive are: poly vinyl acetate-ethylene co-polymer, polyvinyl pyrrolidone cross-linked with polystyrene sulfonate, polyvinyl alcohol, methyl cellulose, hydroxyethyl methyl cellulose, styrene-butadiene copolymer latex, acrylic ester latex, acrylic copolymer latex, polyester resin, epoxy resin, polymethyl methacrylate, polyacrylic acid and mixtures thereof. These compounds may be used in combination with starch and/or polyvinyl acetate.

The first board may have a liner on one or both faces, for example, a paper liner or a fibreglass mat.

In further embodiments, the first board may be provided by a gypsum fibreboard, that is, a board having a gypsum matrix and about 15-25 wt % cellulose fibres distributed within the gypsum matrix. The faces of gypsum fibreboards are typically not provided with lining sheets.

In yet further embodiments, the first board may be provided by impact-resistant gypsum panels comprising a high-density core and facers provided by heavyweight paper liners or fibreglass mats, such as the panels manufactured according to ASTM C1629.

Preferably, the first and second boards have the same composition. In certain cases, certain properties of the second board may correspond to those of the first board. For example, the second board may have the same flexural stiffness as the first board.

Preferably, the principal component of the spacer, measured by weight, is a resilient material such as a polymer, for example, a porous polymer.

Typically, the porous polymer is expanded polystyrene.

In other embodiments, the spacer may be provided by a composite material, for example, a fibre-reinforced composite material, such as fibreglass.

In further embodiments, the spacer may be provided by a fibrous material, such as cardboard.

In certain cases, the spacer may be hollow.

In general, the spacer has a density less than 60 kg/m$^3$, preferably less than 30 kg/m$^3$, more preferably less than 20 kg/m$^3$. The coefficient of linear expansion of the spacer typically lies in the range 30-80×10$^{-6}$/° C. The compressive modulus of the spacer at 10% compression typically lies in the range 50-390 kPa, preferably 50-200 kPa, more preferably 50-100 kPa.

The spacer is typically affixed to one of the first or second boards by means of an adhesive, such as a pressure-sensitive adhesive. Alternatively, the adhesive may comprise one of more of the following: a hot melt adhesive; a polyvinyl alcohol-based adhesive; a polyvinyl acetate-based adhesive; a cyanoacrylate-based adhesive; an epoxy-based adhesive; a urethane-based adhesive; an acrylic-based adhesive; a latex polymer-based adhesive; a gypsum-based adhesive; or a cement-based adhesive. In certain embodiments, the spacer may be affixed to one of the first and second boards by means of mechanical fixing means such as screws or nails.

In general, the flexural strength (that is, the bending strength) of the first board in at least one in-plane direction of the board is at least 5 MPa, preferably at least 7 MPa, more preferably at least 9 MPa.

The flexural strength of the first board is derived following the test method set out in BS EN 520: 2004+A1: 2009. The test is carried out at a constant loading rate of 250 N/min. The flexural breaking load is recorded and converted to flexural strength using the dimensions of the specimen.

The flexural strength of the first board in a given direction corresponds to the flexural strength of that board when bent about an axis perpendicular to that direction.

In certain cases, the at least one in-plane direction of the board may correspond to the longitudinal direction of the board.

For example, the first board may comprise fibres that have a preferential direction of alignment that may correspond to the direction of deposition of the board during manufacture (this direction is sometimes referred to as the "machine direction"). Typically, this direction corresponds to the longitudinal direction of the board. In such cases, the at least one in-plane direction of the board may correspond to the preferential direction of alignment of the fibres.

Preferably, the flexural strength of the first board in at least one in-plane direction of the board is at least 5 MPa, preferably at least 7 MPa, more preferably at least 9 MPa and the flexural strength of the first board in the in-plane cross direction perpendicular to the at least one in-plane direction is greater than 4 MPa, preferably greater than 5 MPa, more preferably greater than 6 MPa.

In a second aspect, the present invention may provide a method of constructing a partition according to any one of the preceding claims, comprising the steps of:

providing a plurality of elongate upright members;

mounting a first board onto one side of a pair of the elongate upright members that are adjacent to each other, such that the first board spans the gap between the pair of adjacent elongate upright members and contacts the elongate upright members on its inner face;

affixing a spacer onto the inner face of the first board;

mounting a second board onto the other side of the pair of adjacent elongate upright members, such that the second board spans the gap between the pair of adjacent elongate upright members.

The step of affixing the spacer onto the inner face of the first board may be carried out before or after the step of mounting the first board onto the pair of adjacent elongate upright members.

Typically, the step of affixing the spacer onto the inner face of the first board comprises removing a tab from a surface of the spacer to expose an adhesive layer, preferably a layer of pressure sensitive adhesive. However, in other cases, the step of affixing the spacer onto the inner face of the first board may comprise the step of applying an adhesive to the inner face of the first board and/or to a surface of the spacer. As an alternative, the spacer may be affixed onto the inner face of the first board using mechanical fixings, such as one or more nails or screws.

Preferably, after the steps of attaching the spacer to the first board and mounting the first board onto the pair of adjacent elongate upright members, but before the step of mounting the second board onto the pair of adjacent elongate upright members, the spacer projects from the inner face of the first board by an amount that is greater than the thickness of the elongate upright members in the same direction, typically at least 0.5% greater, preferably at least 2% greater, more preferably at least 4% greater, most preferably at least 6% greater.

Preferably, the flexural stiffness of at least one of the first and second boards in at least one in-plane direction of the respective board is at least 3.5 GPa, preferably at least 4.5 GPa, more preferably at least 5 GPa. Typically, the maximum flexural stiffness of that board in the at least one in-plane direction of the board is less than 15 GPa, in general less than 10 GPa. The flexural stiffness of the board is derived following the test method set out in relation to the first aspect of the invention.

The flexural stiffness of the board in a given direction corresponds to the flexural stiffness of that board when bent about an axis perpendicular to that direction.

In certain cases, the at least one in-plane direction of the board may correspond to the longitudinal direction of the board.

For example, the board may comprise fibres that have a preferential direction of alignment that may correspond to the direction of deposition of the board during manufacture (this direction is sometimes referred to as the "machine direction"). Typically, this direction corresponds to the longitudinal direction of the board. In such cases, the at least one in-plane direction of the board may correspond to the preferential direction of alignment of the fibres.

Preferably, the flexural stiffness of the first board in at least one in-plane direction of the board is at least 3.5 GPa, preferably at least 4.5 GPa, more preferably at least 5 GPa and the flexural stiffness of the first board in the in-plane cross direction perpendicular to the at least one in-plane direction is greater than 3 GPa, preferably greater than 3.5 GPa, more preferably greater than 4 GPa.

In general, the flexural strength of at least one of the first and second boards in at least one in-plane direction of the board is at least 5 MPa, preferably at least 7 MPa, more preferably at least 9 MPa.

The flexural strength of the board is derived following the test method set out in relation to the first aspect of the invention.

The flexural strength of the board in a given direction corresponds to the flexural strength of that board when bent about an axis perpendicular to that direction.

In certain cases, the at least one in-plane direction of the board may correspond to the longitudinal direction of the board.

For example, the board may comprise fibres that have a preferential direction of alignment that may correspond to the direction of deposition of the board during manufacture (this direction is sometimes referred to as the "machine direction"). Typically, this direction corresponds to the longitudinal direction of the board. In such cases, the at least one in-plane direction of the board may correspond to the preferential direction of alignment of the fibres.

Preferably, the flexural strength of the first board in at least one in-plane direction of the board is at least 5 MPa, preferably at least 7 MPa, more preferably at least 9 MPa and the flexural strength of the board in the in-plane cross direction perpendicular to the at least one in-plane direction is greater than 4 MPa, preferably greater than 5 MPa, more preferably greater than 6 MPa.

The partition produced according to the second aspect of the invention may have one or more features of the partition according to the first aspect of the invention.

DETAILED DESCRIPTION

The invention will now be described by way of example only with reference to the following Figures in which.

Figure 1:
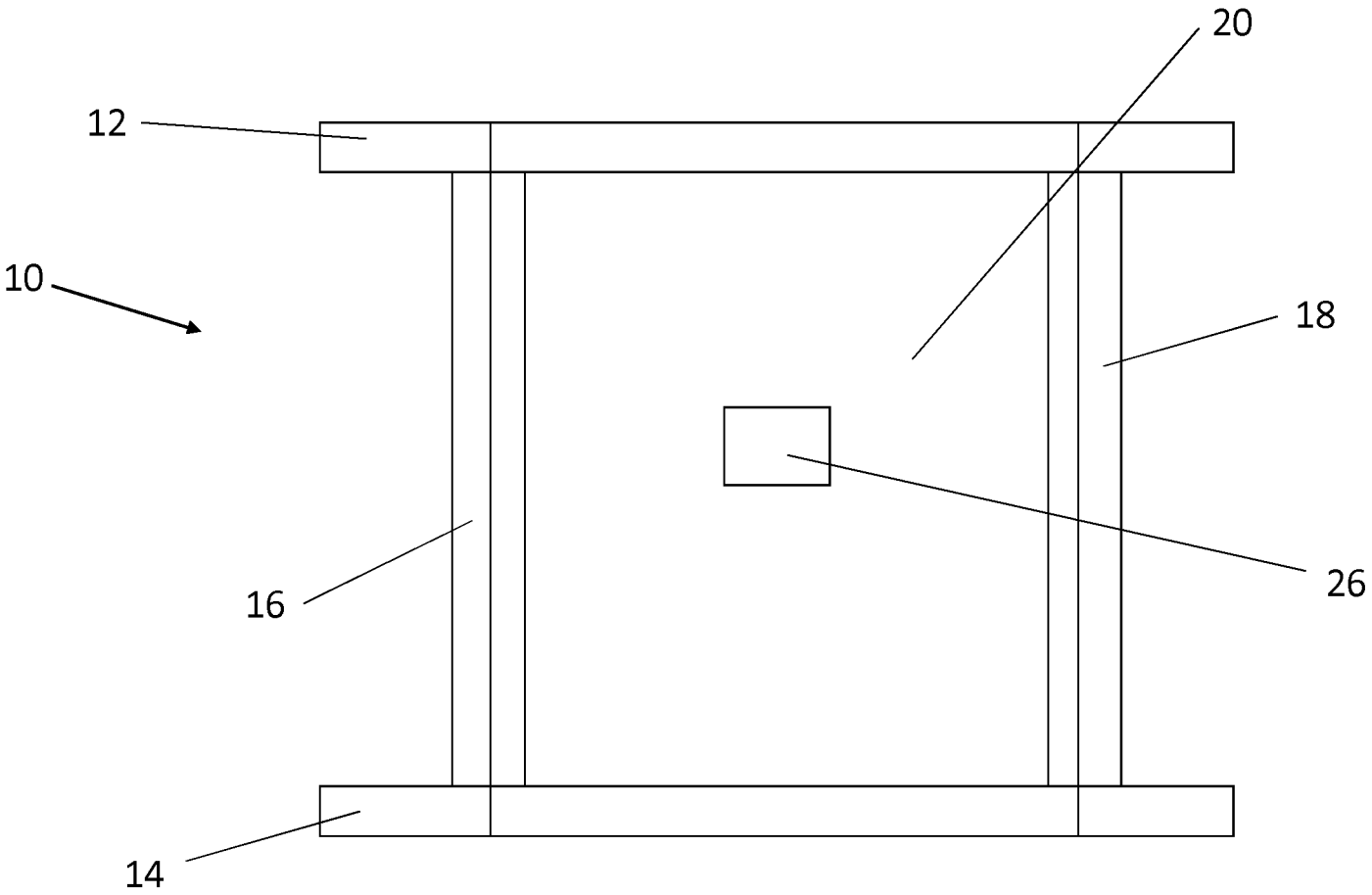
FIG. 1 shows a schematic elevation view of a partition according an embodiment of the first aspect of the invention. The boards are shown only in outline, so as not to obscure the interior detail of the partition.
Figure 2:
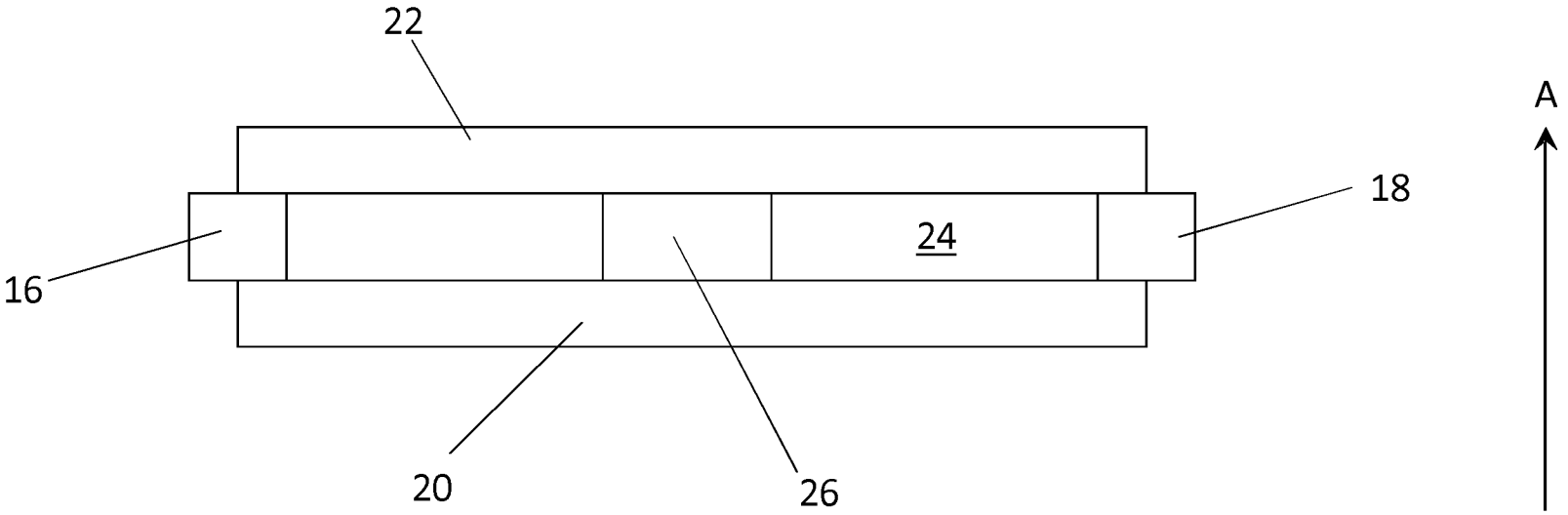
FIG. 2 shows a schematic plan view of a partition according to an embodiment of the first aspect of the invention. The upper horizontal stud is not shown.

Referring to FIGS. 1 and 2, a partition 10 is shown. The partition comprises a stud framework comprising upper and lower horizontal studs 12,14 and a pair of adjacent upright studs 16,18.

Each of the upper and lower horizontal studs 12,14 and the upright studs 16,18 is provided by an elongate element that has been formed from e.g. steel or wood. The studs may each have e.g. a square cross-section, a rectangular cross-section, a C-shape cross-section, or a U-shape cross-section, as is known in the art.

The upper horizontal stud 12 is typically adjacent the ceiling of a room, while the lower horizontal stud 14 is typically adjacent the floor of that room.

The upright studs 16,18 are mounted onto the upper horizontal stud 12 and the lower horizontal stud 14, as is known in the art, and are spaced 900 mm apart. A first board 20 is mounted onto a first side of the stud framework using screws and/or nails, as is known in the art. The first board has a width of 900 mm and a height of 2400 mm, and is positioned to extend from upright stud 16 to adjacent upright stud 18 and from lower horizontal stud 14 to upper horizontal stud 12.

A second board 22 (shown in FIG. 2) is mounted onto a second side of the stud framework, using nails and/or screws, as is known in the art. The second board has the same dimensions as the first board 20 and is positioned in face-to-face correspondence with the first board 20. That is, the second board is positioned to extend from upright stud 16 to adjacent upright stud 18 and from lower horizontal stud 14 to upper horizontal stud 12. This is in contrast with certain arrangements known from the prior art, in which boards are mounted onto a stud framework in a staggered configuration, that is, the boards are offset from each other in a horizontal direction of the stud framework.

The flexural stiffness of the first board 20 in at least one in-plane direction of the board is at least 3.5 GPa, preferably at least 4.5 GPa, more preferably at least 5 GPa. The first board may be e.g. one of the following:

- A plasterboard having a gypsum matrix and preferably having fibres and/or a polymeric additive distributed within the matrix. The fibres may be e.g. glass fibres. The fibres may be present in an amount of at least 1 wt % relative to the gypsum matrix. The polymeric additive may be e.g. starch or a synthetic polymer. The polymeric additive may be present in an amount of at least 1 wt % relative to the gypsum matrix. The plasterboard may have a liner on one or both faces. The liner may be e.g. a paper liner or a fibreglass mat;
- A gypsum fibreboard, that is, a board having a gypsum matrix and about 15-25 wt % cellulose fibres distributed within the gypsum matrix. The faces of gypsum fibreboards are typically not provided with lining sheets;
- A cement board, that is, a board comprising hydraulic cement as its principal component by weight;
- Impact-resistant gypsum panels comprising a high-density core and facers provided by heavyweight paper liners or fibreglass mats, such as the panels manufactured according to ASTM C1629.

Typically, the second board has the same composition and properties as the first board. However, in certain embodiments, the composition and/or properties of the second board may be different from those of the first board.

The two boards 20,22, the upright studs 16,18 and the horizontal studs 12,14 define a cavity 24 therebetween. The dimension of the cavity in the through-thickness direction of the partition 10 is e.g. 50 mm in certain embodiments or 70 mm in other embodiments.

A spacer 26 is located inside the cavity 24. The spacer 26 is approximately equidistant between the adjacent upright studs 16,18 and approximately equidistant between the upper horizontal stud 12 and the lower horizontal stud 14.

The spacer 26 is provided by a block of expanded polystyrene having a cuboid shape. Two opposed faces of the spacer 26 are in respective face-to-face contact with the inner face of the first board 20 and the inner face of the second board 22 (the inner faces of the boards 20,22 being the faces that are oriented towards the cavity 24). The spacer 26 is not in direct contact with any part of the stud framework.

The spacer 26 is typically attached to the inner face of the first or second board by means of a pressure-sensitive adhesive. However, in certain embodiments, a different adhesive may be present, such as a hot melt adhesive. In certain embodiments, the spacer may be glued to the inner faces of both the first and second boards. The thickness of the adhesive may be e.g. 0.15 mm.

The faces of the spacer that are respectively in contact with the inner faces of the first and second boards 20,22 typically have dimensions of 110 mm by 110 mm.

The spacer 26 comprises a resilient material. This allows it to be placed under compressive loading when held within the cavity 24, so that the thickness of the spacer corresponds to the distance between the inner faces of the first and second boards 20,22. Before incorporation into the partition, the spacer has a thickness greater than this distance. For example, in the case that the dimension of the cavity in direction A is 50 mm, the thickness of the spacer before incorporation into the partition may be 51 mm. In the case that the dimension of the cavity in direction A is 70 mm, the thickness of the spacer before incorporation into the partition may be 71 mm. Thus, when incorporated into the partition, the spacer experiences a compressive strain of about 1-2%.

The density of the spacer 26 is about 15 kg/m$^3$. The coefficient of linear expansion of the spacer is about $60\times10^{-6}$/° C. The compressive strength of the spacer at 10% compression is about 70 kPa.

The partition 10 is made by constructing a stud framework from the studs 12,14,16,18, as is known in the art. The first board is mounted on the framework such that its perimeter is superposed on the portion of the framework comprising the pair of adjacent upright studs 16,18 and the sections of the horizontal studs 12,14 lying therebetween. The board is mounted on the framework using e.g. nails or screws, as is known in the art.

The spacer 26 is glued to the inner face of the first board 20 by means of a pressure sensitive adhesive (the inner face of the first board 20 is the face that contacts the stud framework). For example, the spacer 26 may have a first tab on a first one of its surfaces, the tab covering a first adhesive layer. In that case, the first tab is removed to expose the adhesive layer (typically a pressure sensitive adhesive) and the spacer is glued to the inner face of the board.

The spacer may optionally also have a second tab on a second surface that is opposed to the first surface, the tab covering a second adhesive layer. In that case, the second tab is also removed to expose the second adhesive layer.

Whether or not the spacer has a second layer of adhesive, the second board 22 is mounted on the opposite side of the framework from the first board 20, using e.g. nails or screws, as is known in the art. Since the distance between the inner faces of the first and second boards is less than the original thickness of the spacer 26, this causes the spacer to be placed under compressive load.

Typically, further boards are mounted on each side of the stud framework in like manner to provide a continuous partition. The external surfaces of the boards may then be provided with a finishing plaster.

In use, the presence of the spacer 26 helps to reduce inward bowing of the first and/or second boards 20,22, thus increasing perceived partition strength and helping to reduce the occurrence of cracks e.g. at the joints between adjacent boards.

The invention claimed is:

1. A partition mounted on a mounting surface, the partition comprising a plurality of elongate upright members;

the partition further comprising a first board and a second board, the first board being mounted on one side of a pair of the elongate upright members that are adjacent to each other, and the second board being mounted on the other side of the same pair of adjacent elongate upright members, so as to define a cavity between the pair of elongate upright members and the first and second boards;

the partition further comprising a spacer, the spacer being located within the cavity defined by the pair of adjacent elongate upright members and the first and second boards, the maximum dimension of the spacer in the through-thickness direction of the partition being at least 90% of the separation of the two boards;

the partition being configured such that the spacer does not provide a load-transferring cross-member between the pair of adjacent elongate upright members;

the partition being further configured such that the spacer does not provide a load-transferring member between the mounting surface and either of the first and second boards, wherein the spacer contacts both the first and second boards, and the partition is configured such that the spacer experiences compressive loading in the through-thickness direction of the partition, wherein the spacer exhibits a compressive strain of at least 0.5% in the through-thickness direction of the partition, the compressive strain being a difference between a thickness of the spacer as positioned within the cavity as compared to an equivalent thickness of the spacer in a relaxed state.

2. A partition according to claim 1, wherein the spacer does not contact either of the elongate upright members.

3. A partition according to claim 1, wherein the spacer has a maximum dimension of 200 mm.

4. A partition according to claim 1, wherein the distance between the pair of adjacent elongate upright members is at least 700 mm.

5. A partition according to claim 1, wherein the first board comprises hydraulic cement or gypsum as a principal component by weight of the first board.

6. A partition according to claim 5, wherein the first board comprises a gypsum matrix having fibres distributed therein, the fibres being present in an amount of at least 1 wt % relative to the weight of the gypsum.

7. A partition according to claim 5 wherein the first board comprises a gypsum matrix having a polymeric component distributed therein in an amount of at least 5 wt % relative to the weight of the gypsum.

8. A partition according to claim 1, wherein the principal component of the spacer, measured by weight, is a porous polymer.

9. A partition according to claim 1, wherein the principal component of the spacer, measured by weight, is expanded polystyrene.

10. A partition according to claim 1, wherein the spacer has a density less than 30 $kg/m^3$.

11. A partition according to claim 1, wherein the spacer is affixed to one of the first or second boards by means of an adhesive.

12. A partition according to claim 1, wherein the flexural stiffness of the first board in at least one in-plane direction of the board is at least 3.5 GPa.

13. A partition according to claim 1, wherein the flexural stiffness of the first board in at least one in-plane direction of the board is at least 5 GPa.

14. A partition according to claim 1, wherein the spacer does not contact either of the elongate upright members and has a maximum dimension of 200 mm;

wherein the distance between the pair of adjacent elongate upright members is at least 700 mm;

wherein the first board comprises hydraulic cement or gypsum as a principal component by weight of the first board;

wherein the principal component of the spacer, measured by weight, is a porous polymer; and wherein the flexural stiffness of the first board in at least one in-plane direction of the board is at least 3.5 GPa.

15. A partition according to claim 1, wherein a thickness of the spacer when located within the gap is no more than 99.5% of an equivalent dimension of the spacer in a relaxed state.

16. A partition according to claim 1, wherein the spacer exhibits a compressive strain of at least 2% in the through-thickness direction of the partition.

17. A method of constructing a partition according to claim 16, the method comprising:

providing a plurality of elongate upright members;

mounting a first board onto one side of a pair of the elongate upright members that are adjacent to each other, such that the first board spans a gap between the pair of adjacent elongate upright members and contacts the elongate upright members on an inner face of the first board;

affixing a spacer onto the inner face of the first board that contacts the elongate upright members; and mounting a second board onto an opposite side of the pair of adjacent elongate upright members, such that the second board spans the gap between the pair of adjacent elongate upright members, wherein after the steps of affixing the spacer to the first board and mounting the first board onto the pair of adjacent elongate upright members, and before the step of mounting the second board onto the pair of adjacent elongate upright members, the spacer projects from the inner face of the first board by an amount that is greater than the thickness of the elongate upright members in the same direction, and wherein the mounting of the second board compresses the spacer is compressed between the first board and the second board.

18. A method according to claim 17, wherein the step of affixing the spacer onto the face of the first board comprises removing a tab from a surface of the spacer to expose an adhesive layer.

19. A method according to claim 17 wherein the spacer projects from the inner face of the first board by an amount that is at least 0.5% greater than the thickness of the elongate upright members in the same direction.

20. A method according to claim 17 wherein the spacer projects from the inner face of the first board by an amount that is at least 2% greater than the thickness of the elongate upright members in the same direction.

* * * * *